US007712158B2

(12) United States Patent
Mehta

(10) Patent No.: US 7,712,158 B2
(45) Date of Patent: May 11, 2010

(54) NON-CLOG SHREDDER

(76) Inventor: Vinod Kumar Mehta, 1173 Mallard Way, Pittsgrove, NJ (US) 08318

( * ) Notice: Subject to any disclaimer, the term of this patent is extended or adjusted under 35 U.S.C. 154(b) by 442 days.

(21) Appl. No.: 11/268,165

(22) Filed: Nov. 7, 2005

(65) Prior Publication Data

US 2007/0101484 A1 May 10, 2007

(51) Int. Cl.
*E03D 9/10* (2006.01)

(52) U.S. Cl. ..... 4/319; 241/46.01; 241/46.11; 241/46.17; 415/121.1

(58) Field of Classification Search ..... 4/319; 241/43, 45, 86, 88.1, 88.2, 89.4, 152.2, 46.01, 241/46.02, 46.06, 46.11, 46.17; 415/121.1
See application file for complete search history.

(56) References Cited

U.S. PATENT DOCUMENTS 3,323,650 A * 6/1967 Kilbane, Jr. ..... 241/46.17 X
3,650,481 A * 3/1972 Conery et al. ..... 241/46.11
4,052,758 A 10/1977 Arena ..... 4/79
4,739,525 A 4/1988 De Graw et al. ..... 4/319
5,460,482 A * 10/1995 Dorsch ..... 415/121.1
6,190,121 B1 * 2/2001 Hayward et al. ..... 415/121.1

* cited by examiner

*Primary Examiner*—Robert M Fetsuga
(74) *Attorney, Agent, or Firm*—Ash Tankha

(57) ABSTRACT

Disclosed herein is a non-clog shredder that is used to shred solid matter entrained in a non-homogenous liquid-solid feed. In one embodiment of the invention, the shredder is located at the bottom of a toilet bowl and is used to shred solid disposable products such as napkins and diapers that are discarded in the toilet bowl. The shredder comprises a generally cylindrical cup that is open at one end, with a circular end-cap at the other end. The end-cap has an axial opening that allows the feed to pass through the cup. In one embodiment of the invention, the opening has recesses and/or teeth on the periphery of the opening. An impeller disposed against the circular end plate creates suction for transfer of the waste through the shredder. A cutting blade on the impeller assembly projects axially through the opening in the end-cap.

6 Claims, 11 Drawing Sheets

NON-CLOG SHREDDER

BACKGROUND OF THE INVENTION

The present invention, in general, relates to a shredder for shredding semi-solid or particulate matter entrained in a non-homogenous liquid-solid flow. The shredder disclosed herein finds an application in process industries, for example in the ore, paper, pulp, food and fiber industries for macerating particulate or solid material in an incoming liquid-solid feed.

An example of the application of the shredder disclosed herein is in marine and recreational vehicle toilets. These toilets are designed to accept waste, such as human waste and toilet paper which can be easily flushed down the toilet. But if products such as feminine hygiene and diapers are discarded in the toilet, the toilet often clogs. Repeated attempts to flush such products down the toilet may eventually be successful but it results in excessive usage of fresh water. In one embodiment of the invention disclosed herein, the shredder is located downstream of the toilet bowl discharge line of a marine or recreational vehicle toilet to prevent clogging of toilets, especially when products such as feminine hygiene products and baby diapers are discarded in the toilet bowl.

In general, there is an unsatisfied market need for shredding solid matter in an incoming liquid-solid feed without clogging the line transporting such flow.

DETAILED DESCRIPTION OF THE INVENTION

The method and apparatus of this invention, including all its embodiments are herein referred to as a shredder.

Figure 1A:
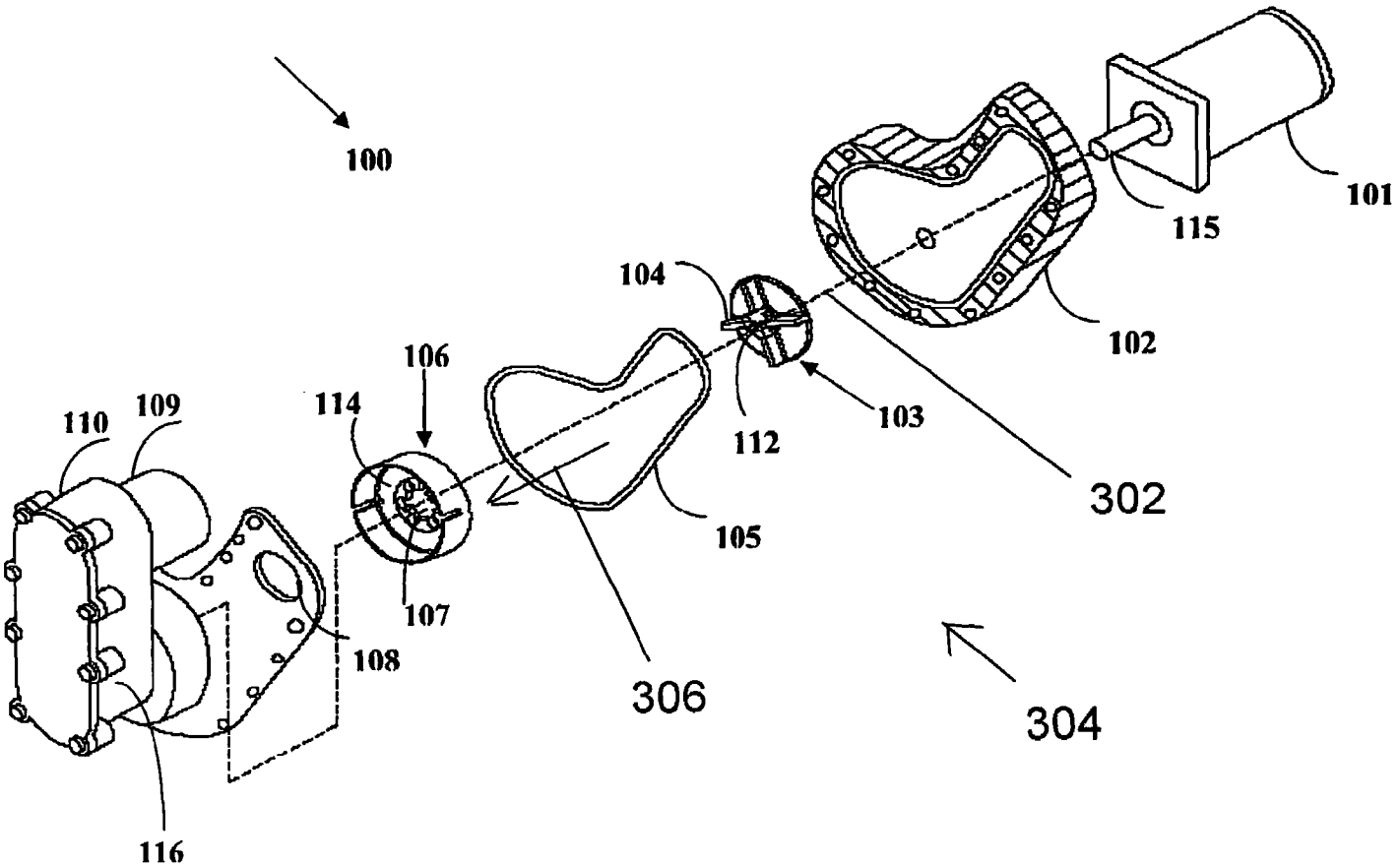
FIG. 1A illustrates the exploded view of the shredder.

FIG. 1A illustrates the exploded view of the shredder 100. The shredder housing 110 comprises an inlet line 109, also referred to herein as inlet 109, through which the liquid-solid feed enters the reservoir 116 located in the front section of the shredder housing 110, a generally cylindrical cup 106 that is open at the upstream end with respect to the incoming liquid-solid flow and capped at the other end by a circular end-cap 114 with an axial opening 107 through which the cutting blade 112 projects in an upstream direction 306 into the cup 106, an impeller assembly 103 mounted on a shaft 115, and a motor 101 that drives the shaft 115. The cup 106 including the end-cap 114 is stationary and does not rotate. Shaft 115 has an axis of rotation 302.

An O-ring 105 on the discharge side of the shredder 100 provides a seal between the front section of the housing 110 and the rear section of the housing 102.

Figure 1B:
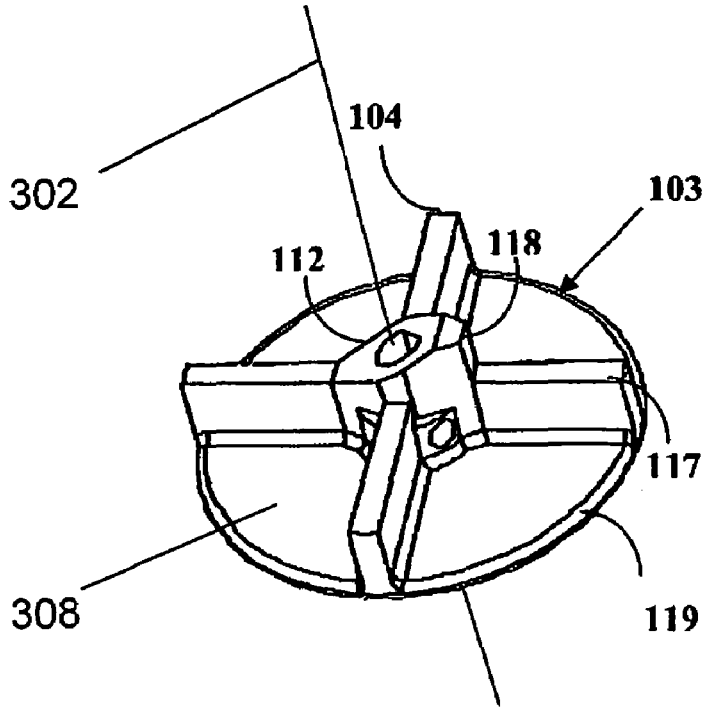
FIG. 1B illustrates the impeller assembly.

FIG. 1B illustrates one embodiment of the impeller assembly 103. The impeller assembly 103 consists of impellers 104 rigidly affixed to the impeller plate 119 and extending radially from the center of the impeller plate 119 towards the circumference of the impeller plate 119 and perpendicular to the upstream face 308 of the impeller plate 119 with the cutting blade 112 located at the center of the impeller 104. In one embodiment of the invention shown in FIG. 1B, the impeller assembly 103 consists of two impellers 104 positioned at right angle to each other with an integrally machined or cast cutting blade 112. In another embodiment of the invention, the cutting blade 112 may be cast separately from the impeller 104 and thereafter rigidly affixed to the impeller 104. In the assembled position, the impeller assembly 103 is positioned with the impeller 104 adjacent to and abutting the downstream surface 310 of the end-cap 114 with the cutting blade 112 projecting through and upstream of the axial opening 107 in the end-cap 114. With the shedder in operation, the cutting surface 118 of the cutting blade 112, also referred to herein as the blade cutting surface 118, shreds solid matter in the liquid-solid feed as the feed approaches the opening 107 in cup 106. The surface 117 of the impeller 104, also referred to herein as the impeller cutting surface 117, rotates adjacent to and immediately downstream of the end-cap 114. The relative motion of the impeller cutting surface 117 over the downstream surface 310 of the end-cap 114 in a shredding engagement shreds the solid matter in the liquid-solid feed at the downstream surface of the opening 107, and in one embodiment of the invention where the opening has a plurality of recesses 113, also at the downstream surface of the recesses 113. The blade cutting surface 118 is oriented generally parallel to the axis of rotation 302 and the impeller cutting surface 117 is oriented generally normal to the axis of rotation 302. The impeller assembly 103 is located in the housing 110 of the shredder 100. The shaft 115 is connected at one end to the center of the impeller plate 119 and to the variable speed motor 101 at the other end. In one embodiment of the invention, impellers 104 shown in FIG. 1D through 1F are axially mounted at one end of the shaft 115, with the other end of the shaft 115 connected to the motor 101. In one embodiment of the invention, the speed of the motor 101 is adjustable. For example, the motor 101 speed may be adjusted to provide a cutting blade 112 rotational speed of approximately 2600 revolutions per minute.

Figure 1C:
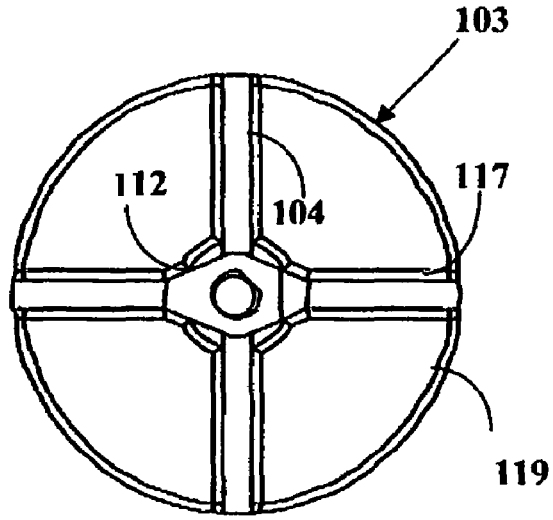
FIG. 1C illustrates the plan view of the impeller assembly.
Figure 1D:
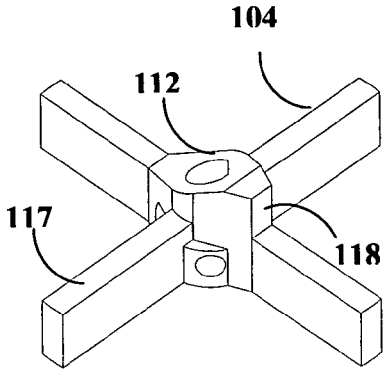
FIG. 1D, FIG. 1E and FIG. 1F illustrate different isometric views of another embodiment of the impeller.
Figure 1E:
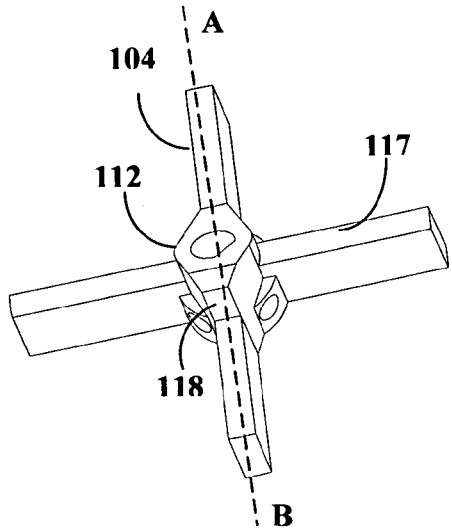
Figure 1F:
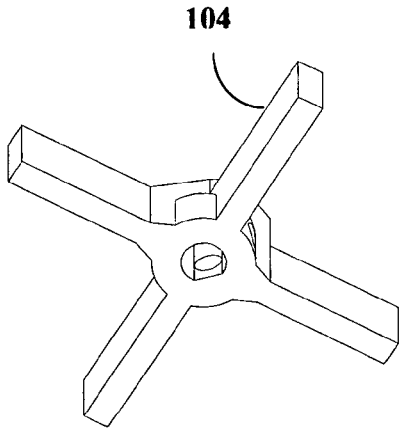

FIG. 1C illustrates the plan view of the impeller assembly 103 showing the impeller 104 and the cutting blade 112 at the center of the impellers 104.

FIG. 1D, FIG. 1E and FIG. 1F illustrates another embodiment of the invention where the impeller assembly comprises only the impeller 104 and the cutting blade 112.

Figure 1G:
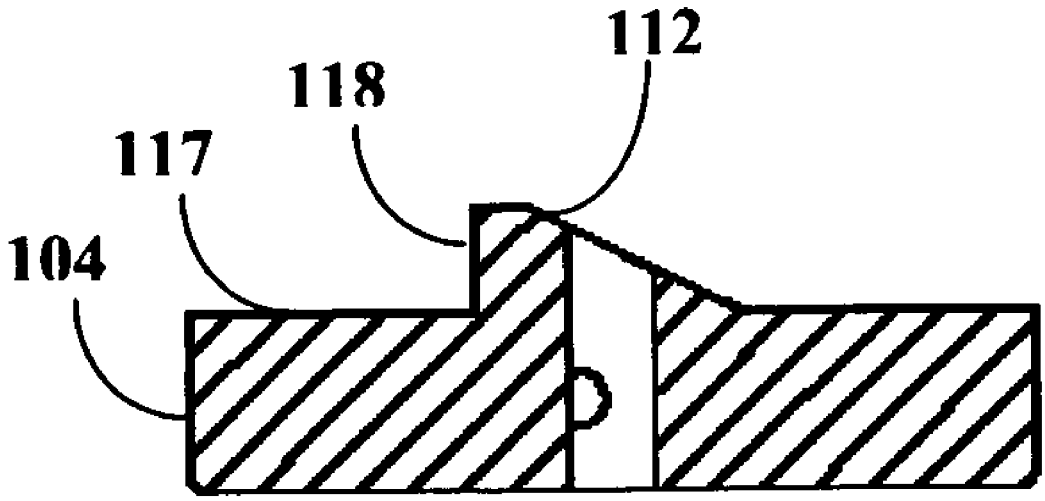
FIG. 1G illustrates the sectional view of the impeller taken along section line A-B of FIG. 1E.

FIG. 1G illustrates the sectional view of the impeller assembly 103 showing the impeller 104, cutting blade 112, cutting surface 118 and impeller surface 117 that abuts the downstream surface of opening 107 and recesses 113.

Figure 1H:
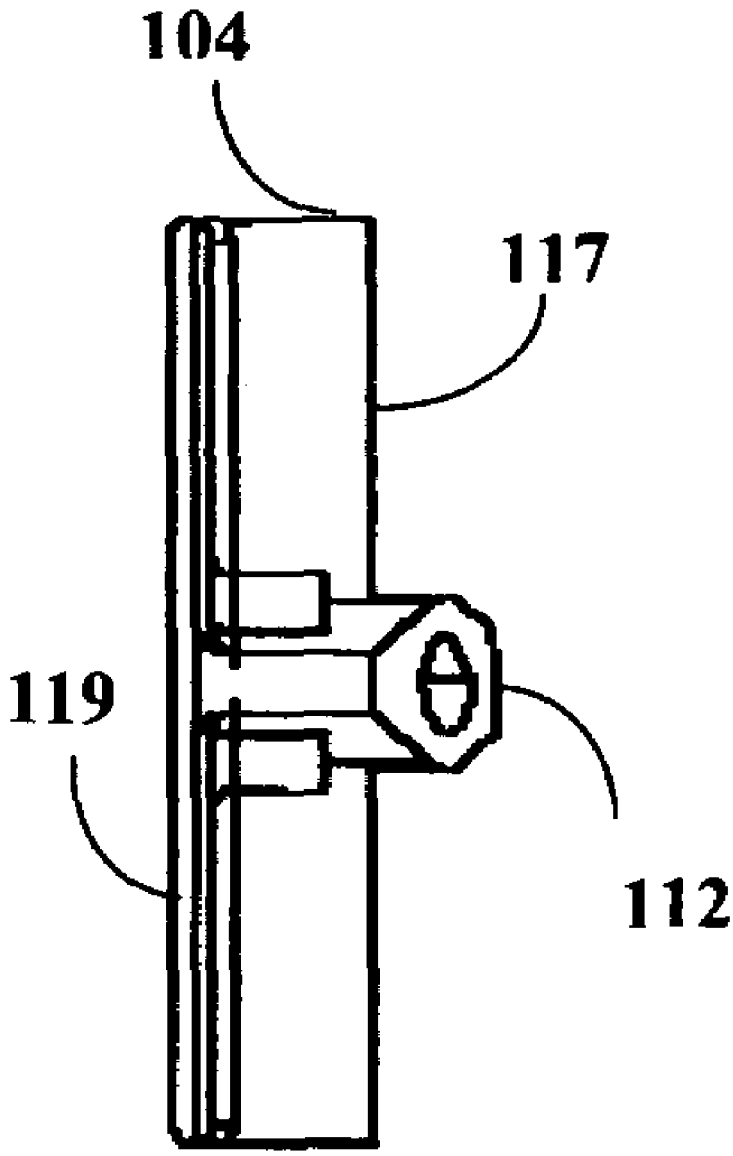
FIG. 1H illustrates the side elevation view of the impeller assembly.

FIG. 1H illustrates the side elevation view of the impeller assembly 103, the impeller 104, cutting blade 112 and impeller plate 119 as shown in FIG. 1B.

Figure 1I:
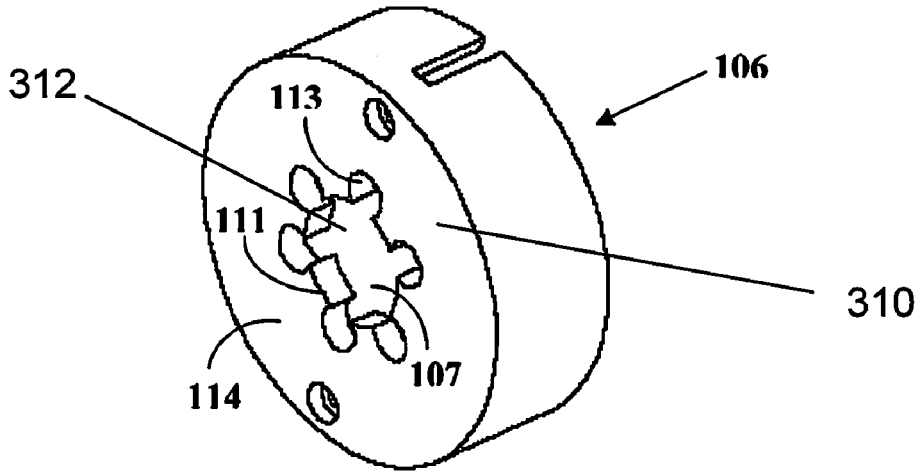
FIG. 1I illustrates the isometric view of the cup.

FIG. 1I illustrates an isometric view of the generally cylindrical cup 106 that is open at one end and has a circular end-cap 114 at the other end. The end-cap 114 has an axial opening 107 opening that provides a conduit 312 for transfer of the feed through the end-cap 114. In one embodiment of the shredder, cutting teeth 111 are located along the circumference of the opening 107. The axial opening 107 may be of any generally circular shape. In another embodiment of the invention, the opening 107 is in the shape of a circle with a plurality of recesses 113. In another embodiment of the invention, cutting teeth 111 are located on the periphery of the opening 107. In yet another embodiment of the invention, the cutting teeth 111 and recesses 113 are located alternately on the periphery of the opening. The relative motion of the section of the impeller blade 112 that projects through opening 107, namely the blade cutting surface 118, with respect the stationary cutting teeth 111 in a shredding engagement, shreds the solid material in the incoming liquid-solid feed as the feed moves through the opening 107. The recesses 113 also provide a conduit for transfer of the incoming feed through the end-cap 114.

Figure 1J:
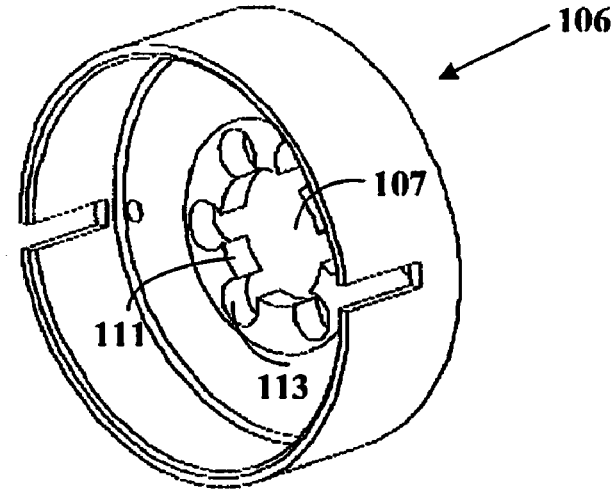
FIG. 1J illustrates another isometric view of the cup.

FIG. 1J illustrates another isometric view of the cup 106 showing the axial opening 107, cutting teeth 111 and recesses 113 located along the periphery of the opening 107.

Figure 1K:
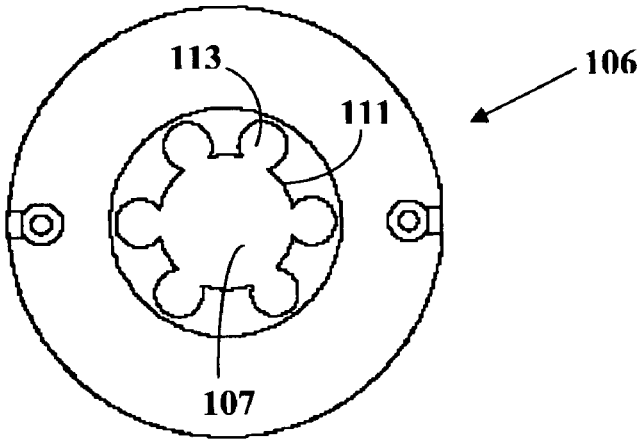
FIG. 1K illustrates the plan view of the cup.

FIG. 1K illustrates the plan view of the cup 106 with the axial opening 107, and the recesses 113 and cutting teeth 111 located along the periphery of the axial opening 107.

Figure 1L:
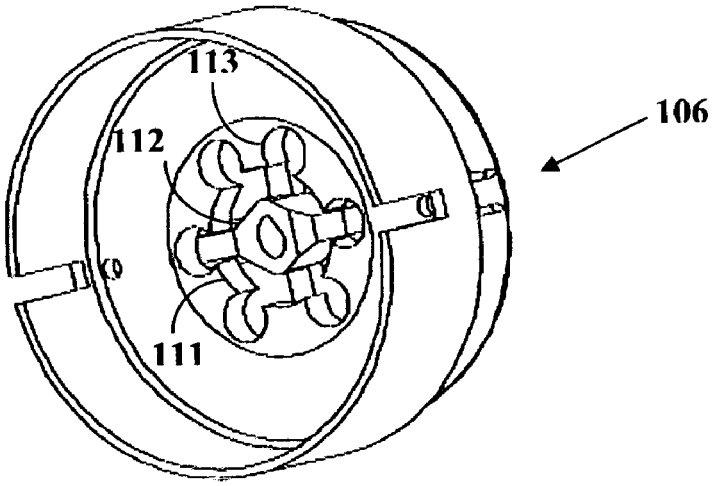
FIG. 1L illustrates the side elevation view of the cup.
Figure 1M:
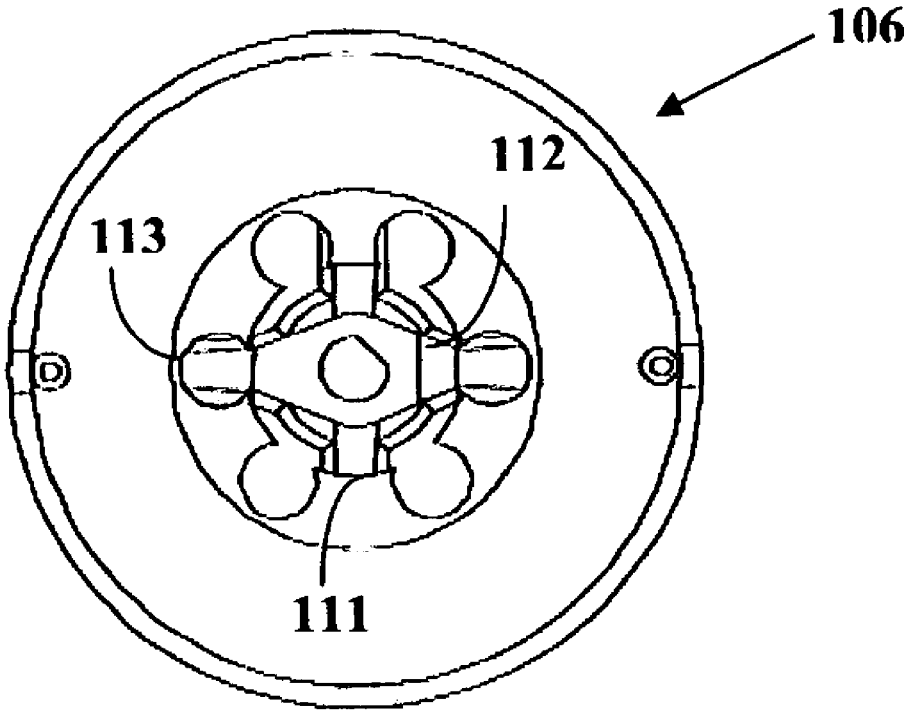
FIG. 1M illustrates an isometric view of the impeller assembly abutting the cup with the cutting blade projecting through the circular opening in the cup.

FIG. 1L and FIG. 1M illustrates the impeller assembly 103 in the assembled position with the impeller assembly 103 adjacent to and abutting the end-cap 114 of cup 106 with the cutting blade 112 projecting through the opening 107 in cup 106.

Figure 2A:
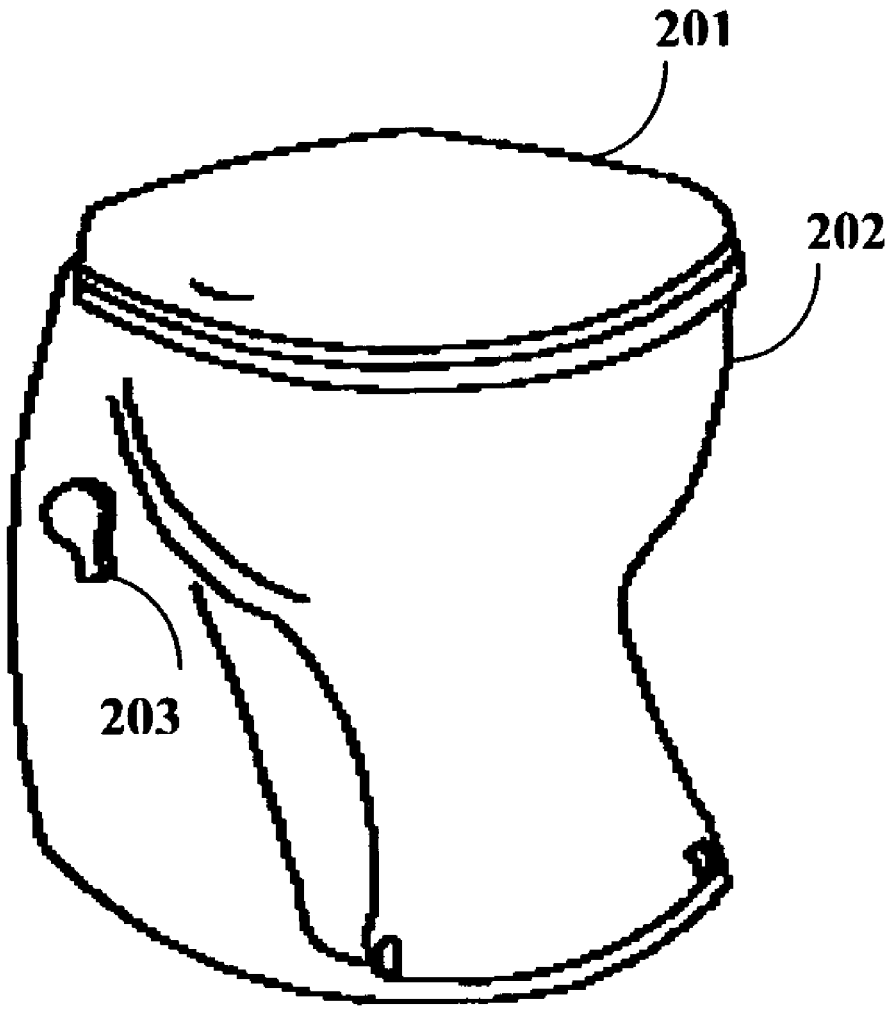
FIG. 2A illustrates the perspective view of the self-contained toilet system.

FIG. 2A illustrates the perspective view of the self-contained toilet system, with the built-in shredder 100. The toilet consists of a seat cover 201, a hand lever 203 and a toilet bowl 202.

Figure 2B:
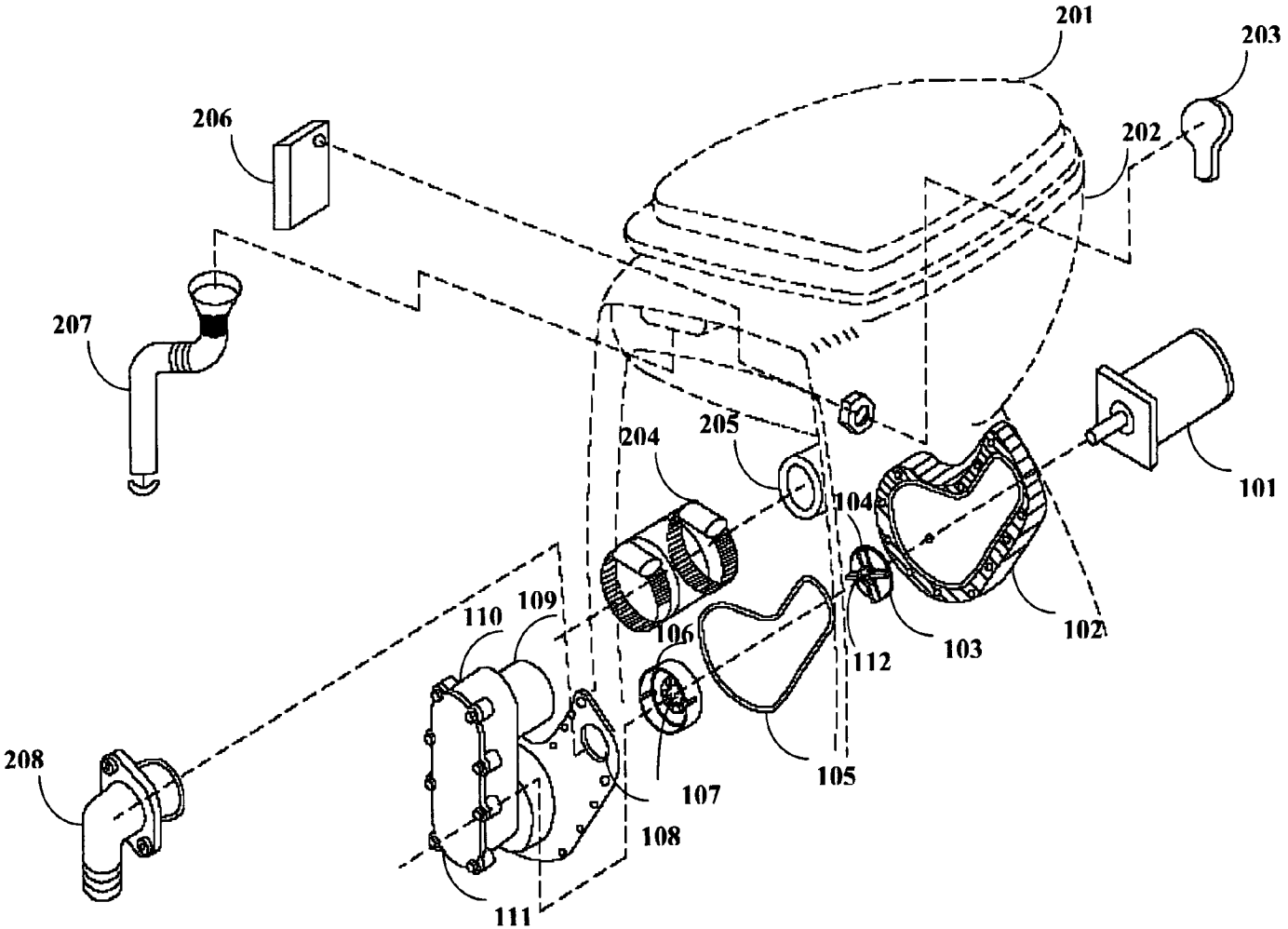
FIG. 2B illustrates the exploded view of the self-contained toilet system with the built-in shredder.

FIG. 2B illustrates an example of the exploded view of a self-contained toilet system with the built in shredder 100. A seat cover 201 is positioned above the toilet bowl 202. The shredder 100 is positioned below the toilet bowl 202. An inlet port 109 accepts the contents of the toilet bowl 202 when the flush is actuated. The shredded waste is discharged through the outlet 108 of the shredder 100. The flush can be either manually operated using a hand lever 203 control or electronically activated using an electronic timer control circuit 206 powered off a wall switch. A solenoid valve (not shown) regulates water consumption during each flush by controlling the inlet water pressure. The hand lever 203 operates a crank (not shown) that is connected to a crank lever. Micro-switches are placed in various locations with respect to crank lever positions. Multi-functional operation of the crank lever is achieved using these micro switches. The hand lever 203 also activates the flush. The electronic timer control circuit 206 sequences the flush by first bringing water in through the intake hose 207, emptying the toilet bowl 202 and re-filling the water in the toilet bowl. A discharge connector 204 is connected to the inlet port 109 of the front section of the shredder housing 110. The outlet 205 of the toilet bowl 202 is connected to the discharge connector 204.

Figure 2C:
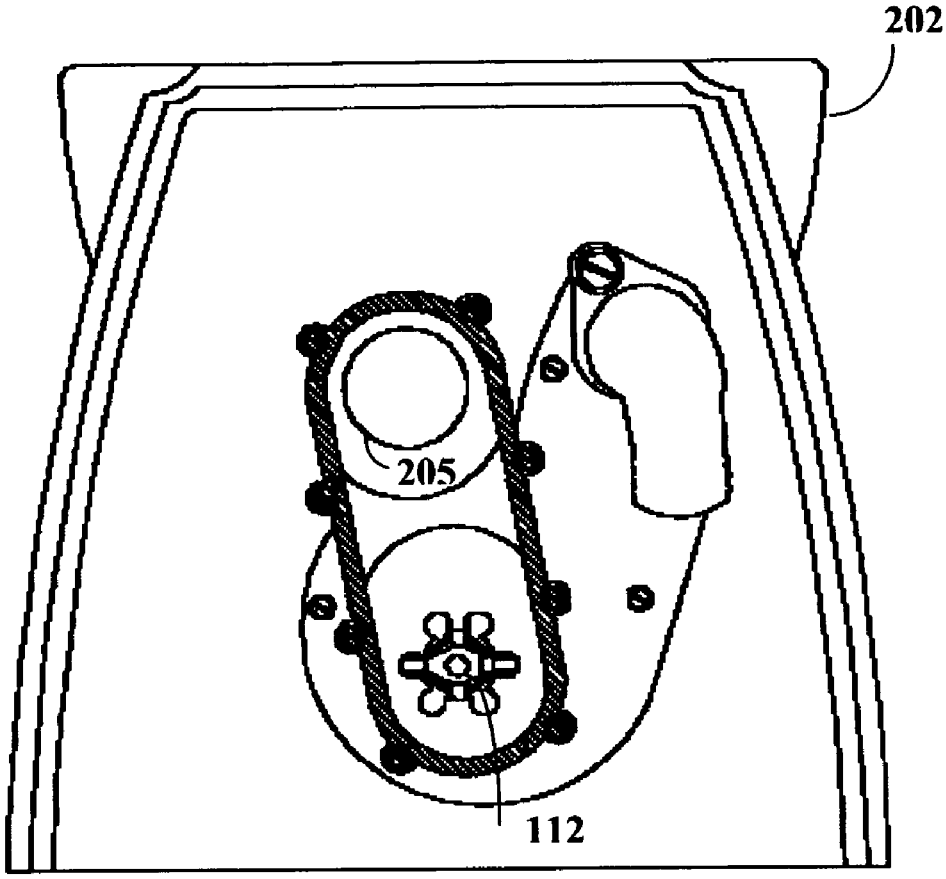
FIG. 2C is a cross-sectional rear view of the self-contained toilet system with built-in shredder.

FIG. 2C is a cross-sectional rear view of the self-contained toilet system with a built-in shredder 100 showing the outlet of the toilet bowl 205, cutting edge 112, the semi-circular recesses 113, and the shredder outlet 108.

When the motor 101 is turned on, the rotation of the impeller over the downstream surface 114 of the cup 106 acts as a centrifugal pump 304, creating suction to effect the transfer of the incoming liquid-solid feed from the reservoir 116 located in the front section of the housing 110 through the opening 107. As the feed moves towards and through the opening 107, the solid material in the feed is shredded by the following: the cutting edge 118 of the rotating cutting blade 112, the cutting surface 117 of the rotating impeller 104 as the solid material in the feed moves to a point immediately downstream of the opening 107 and the recesses 113, and by the rotation of the impeller 104 with respect to the stationary cutting teeth 111 located on the periphery of the opening 107. The centrifugal action of the impeller 104 throws the shredded feed to the rear section of the housing 102 from where the shredded waste is discharged through outlet nozzle 108 located at the upper part of the rear section of the housing 102

In one embodiment of this invention, the apparatus comprises a toilet bowl 202, a discharge opening at the bottom of said toilet bowl 205 and the shredder 100 positioned at the bottom of the toilet bowl 202. When a flush hand lever 203 is actuated, the waste from the toilet bowl feeds through the shredder inlet line 109 to the upstream reservoir 116 located in the front section of the housing 110. The outlet 108 of the shredder 100 is coupled to and in fluid communication with the exterior discharge opening of the toilet bowl 202.

When the flush hand lever 203 is actuated, motor 101 is turned on and waste from the toilet enters the shredder 100 through the inlet line 109. The cutting blade 112 rotates along the upstream surface of the stationary circular end-cap 114 to shred the incoming particulate matter in the liquid-sold feed. The feed containing the shredded particulate matter passes through the opening 107; and, in one embodiment of the invention, through the opening 107 and recesses 113 located on the periphery of the opening 107. The rotation of the impeller blades 104 creates suction to transfer the waste from the upstream reservoir 116 of the shredder to the outlet 108 of the shredder 100. The shredder 100 shreds solid wastes such as feminine hygiene and baby diaper products in addition to human sewage and toilet paper. The shredded feed is discharged through the discharge nozzle 208.

The following example illustrates the working of the shredder 100 in a toilet application. Ms. Jenny goes to a restroom to use the toilet facilities, and needs to dispose off a soiled sanitary napkin. She wraps the soiled sanitary napkin and puts it into the waste basket. Even though quite simple and cost-effective, this conventional method poses a threat of infection to other toilet users through atmospheric dispersal of microbial germs and such disposal also emits an unpleasant odor. If the restroom is equipped with the shredder, Ms. Jenny need not dispose it off in the wastebasket. She can flush the soiled sanitary napkin down the toilet bowl 202. When the flush hand lever 203 is activated, a shredder 100 mounted inside the toilet bowl 202 is also activated. The rotation of the cutting blade 112 and the impeller 104, and the rotation of the impeller 104 with respect to the cutting teeth 111 on the opening 107 shreds the soiled sanitary napkin inside the toilet bowl 202, and the shredded waste is flushed out without clogging the toilet system.

What is claimed is:

1. A shredder for shredding solid matter in an incoming liquid-solid feed, the shredder comprising:

a housing;

an inlet defined by said housing for receiving the incoming feed;

an end-cap contained within said housing, said end-cap having a downstream surface, said end-cap defining an axial opening communicating through said end-cap, said axial opening in fluid communication with said inlet, said axial opening defining a conduit for transfer of the feed through said end-cap;

an impeller assembly located within said housing, said impeller assembly comprising:

a rotatable shaft having an axis of rotation, said axis of rotation being coaxial with said axial opening in said end-cap;

a circular impeller plate mounted axially on said shaft, said impeller plate having an upstream face;

a plurality of impellers attached to said upstream face of said impeller plate, said plurality of impellers extending radially about said axis of rotation of said rotatable shaft, said plurality of impellers, said rotatable shaft and said end-cap in combination defining a centrifugal pump, each of said plurality of impellers having an impeller cutting surface opposite to said upstream face of said impeller plate, each said impeller cutting surface being generally normal to said axis of rotation, said end-cap defining a plurality of recesses along a periphery of said axial opening of said end-cap, each said impeller cutting surface located adjacent to and abutting said end-cap downstream surface proximal to said plurality of recesses, wherein rotation of said impeller cutting surface proximal to said downstream surface of said end-cap defines a shredding engagement;

a cutting blade integrally affixed to said impellers and extending axially in an upstream direction from said impeller cutting surfaces, said cutting blade defining a blade cutting surface, said blade cutting surface oriented generally parallel to said axis of rotation and normal to said impeller cutting surfaces, said cutting blade projecting through said axial opening, said plurality of recesses and said axial opening in combination defining a plurality of stationary cutting teeth, wherein said plurality of recesses and said plurality of cutting teeth are located alternately along said periphery of said axial opening, said blade cutting surface defining a rotating motion proximal to said stationary cutting teeth, wherein said rotating motion of said blade cutting surface proximal to said stationary cutting teeth defining a shredding engagement within said axial opening; and a motor connected to said shaft and configured to rotate said shaft.

2. The opening of claim 1 wherein said recesses are semi-circular, elliptical, or rectangular in shape.

3. The shredder of claim 1 wherein a speed of said motor is variable.

4. A shredder for shredding solid matter in a liquid-solid feed in a toilet system, comprising:

a toilet bowl;

an outlet defined by said toilet bowl;

a housing;

an inlet in said housing for receiving the incoming feed, said inlet being in fluid communication with said outlet;

an end-cap contained within said housing, said end-cap having a downstream surface, said end-cap defining an axial opening communicating through said end-cap, said axial opening being in fluid communication with said inlet, said axial opening defining a conduit for transfer of the feed through said end-cap;

an impeller assembly located within said housing, said impeller assembly comprising:

a rotatable shaft having an axis of rotation, said axis of rotation being coaxial with said axial opening in said end-cap;

a circular impeller plate mounted axially on said shaft, said impeller plate having an upstream face;

a plurality of impellers attached to said upstream face of said impeller plate, said plurality of impellers extending radially about said axis of rotation of said rotatable shaft, said plurality of impellers, said impeller plate, said rotatable shaft and said end-cap in combination defining a centrifugal pump, each of said plurality of impellers having an impeller cutting surface opposite to said upstream face of said impeller plate, each said impeller cutting surface being generally normal to said axis of rotation, said end-cap defining a plurality of recesses along a periphery of said axial opening of said end-cap from said upstream surface to said downstream surface, each said impeller cutting surface being located adjacent to and abutting said end-cap downstream surface proximal to said plurality of recesses, wherein rotation of said impeller cutting surface proximal to said downstream surface of said end-cap defines a shredding engagement;

a cutting blade integrally affixed to said impellers and extending axially in an upstream direction from said impeller cutting surfaces, said cutting blade defining a blade cutting surface oriented parallel to said axis of rotation and normal to said impeller cutting surfaces, said cutting blade projecting through said axial opening, said plurality of recesses and said axial opening in combination defining a plurality of stationary cutting teeth, wherein said plurality of recesses and said plurality of cutting teeth are located alternately along said periphery of said axial opening, said blade cutting surface defining a rotating motion proximal to said stationary cutting teeth, wherein said rotating motion of said blade cutting surface proximal to said stationary cutting teeth defining a shredding engagement within said axial opening; and a motor connected to said shaft and configured to rotate said shaft.

5. The shredder of claim 4 wherein said recesses on said opening in said end-cap are semi-circular, elliptical, or rectangular in shape.

6. The shredder of claim 4 wherein a speed of said motor is variable.

* * * * *